US009719715B2

(12) United States Patent
Qu et al.

(10) Patent No.: US 9,719,715 B2
(45) Date of Patent: Aug. 1, 2017

(54) USING WEATHER DATA IN HEAT PUMP DEFROST CONTROL

(71) Applicant: Lennox Industries Inc., Richardson, TX (US)

(72) Inventors: Yi Qu, Richardson, TX (US); Pete Hrejsa, Richardson, TX (US)

(73) Assignee: LENNOX INDUSTRIES INC., Richardson, TX (US)

( * ) Notice: Subject to any disclaimer, the term of this patent is extended or adjusted under 35 U.S.C. 154(b) by 257 days.

(21) Appl. No.: 14/040,069

(22) Filed: Sep. 27, 2013

(65) Prior Publication Data

US 2015/0089966 A1 Apr. 2, 2015

(51) Int. Cl.

| | |
|---|---|
| ***F25D 21/06*** | (2006.01) |
| ***F25D 21/00*** | (2006.01) |
| ***F25B 30/02*** | (2006.01) |
| ***F25B 49/02*** | (2006.01) |
| ***F25B 47/02*** | (2006.01) |

(52) U.S. Cl.

CPC ..... *F25D 21/006* (2013.01); *F25B 30/02* (2013.01); *F25B 47/025* (2013.01); *F25B 49/02* (2013.01); *F25B 2313/0315* (2013.01); *F25B 2700/172* (2013.01); *F25B 2700/173* (2013.01)

(58) Field of Classification Search

CPC ..... F25D 21/006; F25B 47/025; F25B 30/02; F25B 49/02; F25B 2700/173; F25B 2700/172; F25B 2313/0315

See application file for complete search history.

(56) References Cited

U.S. PATENT DOCUMENTS

| | | | | |
|---|---|---|---|---|
| 4,662,184 | A * | 5/1987 | Pohl | F25D 21/006 62/156 |
| 4,940,079 | A * | 7/1990 | Best | F24D 19/1072 165/236 |
| 5,319,943 | A * | 6/1994 | Bahel | F24F 1/0003 62/156 |
| 5,761,908 | A * | 6/1998 | Oas | F24F 12/006 165/11.1 |
| 2010/0070085 | A1* | 3/2010 | Harrod | F24F 11/0086 700/276 |
| 2010/0070086 | A1* | 3/2010 | Harrod | F24F 11/0086 700/276 |
| 2010/0170282 | A1* | 7/2010 | Kim | F24F 11/0086 62/276 |

* cited by examiner

*Primary Examiner* — Justin Jonaitis
*Assistant Examiner* — Larry Furdge

(57) ABSTRACT

A method of operating a heat pump system is provided, the heat pump system having at least a controller and configured to operate at least two defrost cycles. The method comprises receiving, at the controller, weather data for a defined geographic area proximate to an installed location of the heat pump system; and selecting, based on said weather data, one of the at least two defrost cycles.

13 Claims, 3 Drawing Sheets

USING WEATHER DATA IN HEAT PUMP DEFROST CONTROL

TECHNICAL FIELD

This application is directed, in general, to a heat pump and, more specifically, to using weather data in controlling heat pump defrost selection.

BACKGROUND

A heat pump may be reversibly configured to heat or to cool a climate-controlled space. This dual-role capability may allow the heat pump to replace a separate air conditioner/furnace combination. However, because the heat pump uses electricity for both heating and cooling, efficiency (e.g. HSPF) is of utmost importance. Heat pumps sometimes operate in severe weather conditions of freezing precipitation such as freezing rain, snow, sleet, hail, and the like. Most heat pumps use a top discharge fan system located outdoors. The air leaving the heat pump, through the fan, orifice and grill, has been chilled below the ambient temperature. Freezing precipitation can form on outdoor components of the heat pump system, such as, e.g., the fan system and outdoor heat exchanger (HX) coil, which can impair operation of the fan and the heat pump. Further, the ice buildup may cause ice bridging on certain components, which while the components may continue to operate, may operate at a reduced heat and energy consumption efficiency and also create an objectionable noise, prompting one or more occupants to initiate a service call.

Conventional heat pump systems remove frost using a reverse-cycle defrost, in which the heat pump runs in a cooling mode to defrost outdoor (OD) HX coils and components with heat transported from indoor (ID) HX coils. The heat produced by the reverse-cycle defrost is lost to the outdoor ambient thus reducing the efficiency of the heat pump. Moreover, supplemental heat consumed to temper indoor air during the defrost adds further to the energy penalty. Further, the heat pump unit may not require defrosting, but rather simply removing ice buildup or bridging on certain outdoor components.

SUMMARY

One aspect of the present disclosure provides a controller for a heat pump system, the heat pump system configured to operate at least two defrost cycles. The controller is configured to receive weather data for a defined geographic area proximate to an installed location of the heat pump system; and select, based on said weather data, one of the at least two defrost cycles. In certain embodiments, the controller may be further configured to communicate with data sources external to the heat pump system. In some embodiments, the selected defrost cycle may comprise a primary defrost cycle. In other embodiments, the selected defrost cycle may comprise a secondary defrost cycle.

Another aspect of the present disclosure provides a method of operating a heat pump system, the heat pump system having at least a controller and configured to operate at least two defrost cycles. The method comprises receiving, at the controller, weather data for a defined geographic area proximate to an installed location of the heat pump system; and selecting, based on said weather data, one of the at least two defrost cycles. In certain embodiments, said method is performed during manufacturing or testing of said heat pump system.

Another aspect of the present disclosure provides a heat pump system. The heat pump system comprises an evaporating heat exchanger coil; an outdoor controller configured to initiate at least two defrost cycles; and an indoor controller. The controller may be configured to receive weather data for a defined geographic area proximate to an installed location of the heat pump system; select, based on said weather data, one of the at least two defrost cycles; and communicate the selected defrost cycle to the outdoor controller.

Yet another aspect of the present disclosure provides a controller for a heat pump system, the heat pump system configured to operate at least two weather modes, the controller configured to receive weather data for a defined geographic area proximate to an installed location of the heat pump system; and select, based on said weather data, one of the at least two weather modes.

Still another aspect of the present disclosure provides a method of operating a heat pump system, the heat pump system having at least a controller, the method comprising configuring the heat pump system to operate in a severe weather mode and a non-severe weather mode; receiving, at the controller, weather data for a defined geographic area proximate to an installed location of the heat pump system; determining, based on said weather data, that severe weather conditions are present; and selecting the severe weather mode. In some embodiments the method may further comprise determining, based on said weather data, that severe weather conditions are not present; and selecting the non-severe weather mode.

BRIEF DESCRIPTION

Reference is now made to the following descriptions taken in conjunction with the accompanying drawings, in which.

DETAILED DESCRIPTION

Figure 1:
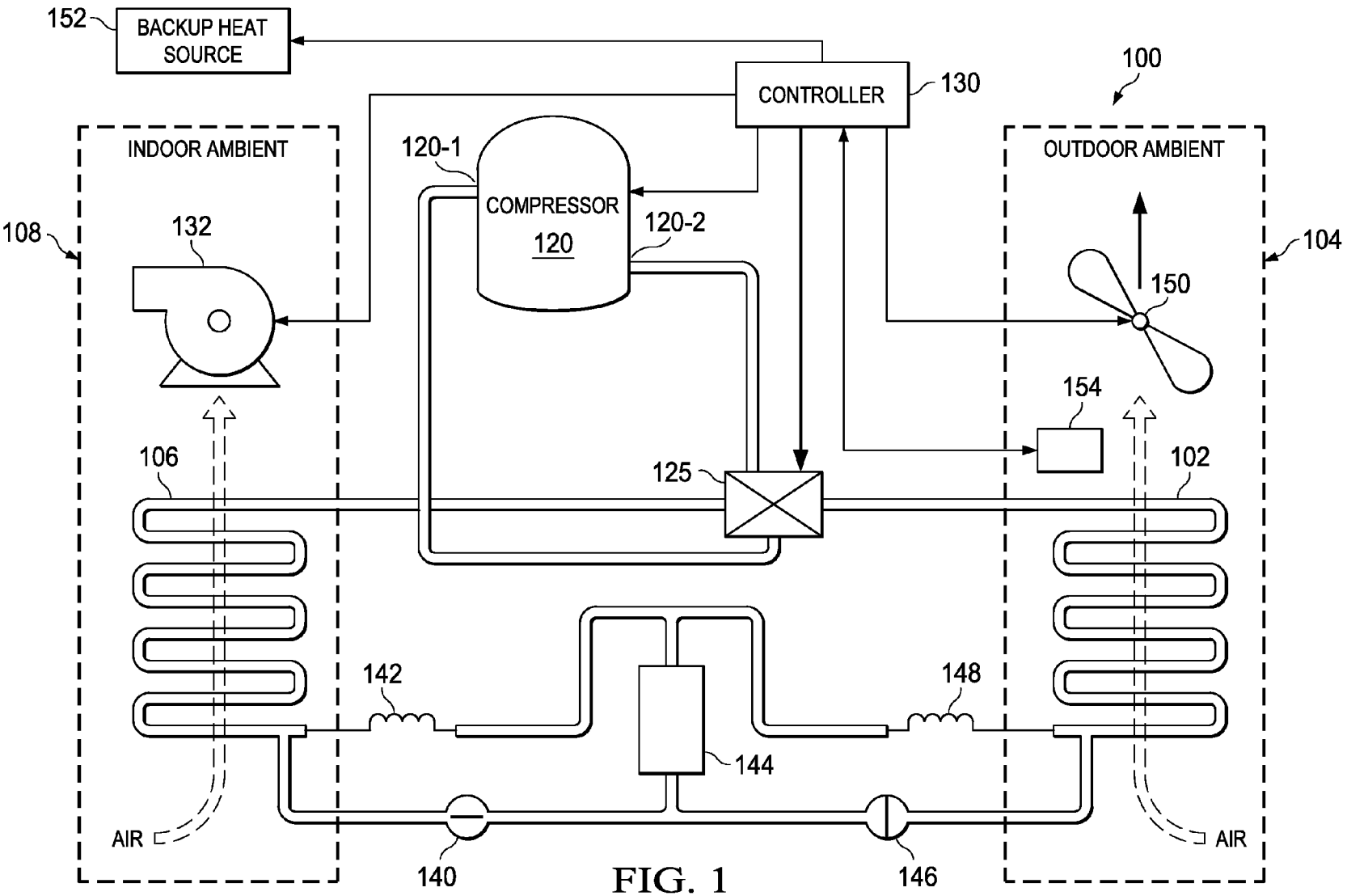
FIG. 1 is a block diagram of a heat pump system of the disclosure operating to transport heat from an outdoor ambient to an indoor ambient.

A heat pump may be utilized in various settings, such as residential air conditioners, commercial air conditioners, and/or refrigerators, for example. During use of the heat pump in low ambient temperatures (e.g., such as heating cycles during low temperatures), a frost event may occur in which frost (e.g., ice) may accumulate on surfaces of component(s) of the heat pump. For example, a housing and/or outdoor components, such as an outdoor fan, outdoor heat exchanger coil and related components, etc. may accumulate ice and/or frost when ambient temperatures are at certain predetermined threshold temperatures. In certain installation locations, the predetermined threshold temperature may be at or below approximately 35 degrees Fahrenheit. When frost accumulates on surfaces of components of the heat pump, such as outdoor heat exchanger coil, an outdoor fan, and proximate components, performance of the heat pump may be reduced and/or wear may increase on components of the heat pump. In some implementations, frost accumulation may inhibit operations of the heat pump. Further, frost and/or ice accumulation may create an objectionable noise leading an occupant of the conditioned space to contact a technician to attend to incorrectly perceived problems with the heat pump system. Such maintenance calls result in additional service costs and draw resources away from other customers or systems with more critical operating issues.

To reduce the impact of a frost event on surfaces of the heat pump (e.g., an outdoor fan, a housing, and/or heat exchanger coil), various defrost cycles are used. A primary defrost cycle may be generally utilized for defrosting the outdoor HX coil. The primary defrost cycle generally comprises a reverse-cycle defrost, in which the heat pump runs in a cooling mode. The evaporating heat exchanger (e.g. outdoor HX coil) operates as a condenser thereby increasing a temperature proximate the heat exchanger, during which the outdoor fan is not running. The primary defrost cycle is generally terminated when a first predetermined threshold temperature is reached at the outdoor HX coil, indicating that the outdoor HX coil has been "defrosted." The primary defrost cycle can also be terminated by a pre-set timer. A temperature sensor proximate the outdoor HX coil communicates with an outdoor controller when the first predetermined threshold temperature is reached.

In certain circumstances, a secondary defrost cycle may be utilized. The secondary defrost may be in addition to a traditional primary defrost cycle. When utilizing the secondary defrost cycle, the cooling cycle continues to run after the first predetermined threshold temperature is reached. When the first predetermined threshold temperature is reached, the outdoor fan is re-started slowly and runs until either a second predetermined threshold temperature is reached, indicating both the outdoor HX coil and fan have been defrosted, or after a certain amount of time has passed. The secondary defrost cycle is generally utilized for defrosting and/or de-icing additional outdoor components such as the outdoor fan and proximate components. Such secondary defrosts are more time and energy consuming than traditional primary defrost cycles. However, in certain units, the heat pump may be configured to run a secondary defrost cycle automatically at certain intervals in order to pre-emptively prevent or mitigate frost accumulation. Even though outdoor ambient conditions may require the heat pump system to operate in a heating mode, the outdoor weather conditions may not necessarily result in frost or ice accumulation on all of the outdoor components. Running the secondary defrost cycle under such conditions automatically results in more energy consumption than necessary than used for a traditional primary defrost cycle.

The present disclosure relates to utilizing current weather data for a geographic location proximate an installed location of the heat pump system for selecting a defrost cycle. By utilizing current weather data, the controller may select a primary or secondary defrost cycle according to actual conditions rather than automatic selection, thereby saving energy consumption, costs, and other disadvantages as discussed hereinabove. The criteria for selecting which defrost cycle may be predetermined for all units, or may be programmed for each unit depending on the installation location for the heat pump system. For example, in certain installation locations, when outdoor ambient temperature is at out below 40° F., e.g., the heat pump system is most likely utilized in a heating mode, but the operating conditions may not require the secondary defrost cycle. During the foregoing conditions, running a secondary defrost at automatic intervals would result in energy consumption that may be unnecessary since there would most likely not be any frost or ice accumulation on the outdoor components.

However if there is precipitation or high humidity levels combined with a low ambient temperature such as, e.g., 35° F., and/or severe weather conditions, the heat pump system is likely to encounter ice and/or frost accumulation on the fan and proximate outdoor components in addition to the outdoor HX coil. During such weather conditions, the secondary defrost cycle may be necessary.

Alternatively, under some weather conditions, it may be advantageous to remove ice from outdoor components prior to or rather than running a first or second defrost cycle. Accordingly, a controller of the heat pump system may be configured to receive weather data for a defined geographic area proximate to an installed location of the heat pump system; and select, based on said weather data, one of the primary or secondary defrost cycles or to run a de-icing cycle. Further, the controller may be configured to select, based on said weather data, a severe weather operating mode wherein a de-icing cycle may be utilized, or select a non-severe weather operating mode wherein the heat pump may be configured to run at least a primary defrost cycle and in some embodiments, to run a secondary defrost cycle.

An outdoor controller component may thereafter receive the selection and operate the unit accordingly when defrost or de-icing cycle is needed. Determining when the defrost or de-icing cycle is needed may be based on several factors such as fan performance data, including, e.g., revolutions per minute (RPM), or alternatively a temperature sensor proximate the outdoor HX coil and/or a temperature sensor for reading outdoor ambient, or a time passed since last defrost.

Described herein are various embodiments of an improved heat pump system in which at least multiple components thereof communicate with a controller. The communication may be via a data bus, wireless communications, and other communication methods known to those skilled in the art. The following discussion describes various embodiments in the context of heating and cooling an indoor ambient, such as a residential living area. Such applications are often referred to in the art as HVAC (heating-ventilating and air conditioning). Such references do not limit the scope of the disclosure to use in HVAC applications, nor to residential applications. As will be evident to those skilled in the pertinent art, the principles disclosed may be applied in other contexts with beneficial results, including without limitation mobile and fixed refrigeration applications. For clarity, embodiments in the following discussion may refer to heating or cooling a residential living space without loss of generality.

Referring initially to FIG. 1, illustrated is a block diagram of a heat pump system 100 according to the disclosure. The system 100 may be used in, e.g., residential/commercial HVAC, retail grocery refrigerators (such as those used in grocery stores), refrigerated warehouses, domestic refrigeration and refrigerated transport. The system 100 includes an outdoor heat exchanger (HX) coil 102 in an outdoor ambient 104, and an indoor HX coil 106 in an indoor ambient 108. In the heating mode the outdoor HX coil 102 acts as an evaporating coil that extracts heat from outdoor ambient 104, and the indoor HX coil 106 acts as a condensing coil that releases heat to the indoor ambient 108. In cooling mode, the roles of the HX coils 102, 106 are reversed.

The system 100 as illustrated is configured to operate in a "pumped heating mode," e.g. to transport heat from the outdoor HX coil 102 to the indoor HX coil 106. Conceptually, in this mode the outdoor ambient 104 may be viewed as a heat source, and the indoor ambient 108 may be viewed as a heat sink. When the system 100 is configured to operate in a "cooling mode," e.g. to transport heat from the indoor HX coil 106 to the outdoor HX coil 102, the ID ambient 108 is the heat source and the outdoor ambient 104 is the heat sink.

The operation of the system 100 in the configuration of FIG. 1 is now described in the context of the pumped heating mode without limitation to a particular application thereof. A compressor 120 includes an input port 120-1 and an output port 120-2. The compressor 120 and the HX coils 102, 106 from a closed system that includes a refrigerant. The compressor 120 pressurizes the refrigerant, which then flows to a flow valve 125.

A controller 130 controls the operation of the components of the system 100, including the compressor 120. The controller 130 may include any combination of electronic, mechanical and electro-mechanical components configured to control the components of the system 100 within the scope of the disclosure. Non-limiting examples of components include microprocessors, microcontrollers, state machines, relays, transistors, power amplifiers and passive electronic devices. The controller 130 may comprise an outdoor controller which communicates with an indoor controller, such as, e.g. a thermostat, which may comprise a general-purpose personal computer, a workstation, a server computer, or any other suitable device which may be configured with a user interface and configured to communicate not only with the outdoor controller 130, but data sources external to the heat pump unit.

The flow valve 125 may comprise a reversing slide valve. The following description is presented without limitation for the case that the flow valve 125 is a reversing slide valve. While a reversing slide valve may be beneficially used in various embodiments of the disclosure, those of ordinary skill in the pertinent arts will appreciate that similar benefit may be obtained by alternate embodiments. Embodiments discussed below expand on this point. In one embodiment, flow valve 125, is consistent with the construction of reversing slide valves, and may comprise a Ranco type V2 valve available from Invensys Controls, Carol Stream, Ill., USA. The flow valve 125 may comprise multiple ports whereby a sliding portion within may be positioned accordingly depending on whether the unit is in a heating, cooling, or defrost mode.

When the compressor 120 is operating, refrigerant flows from the compressor 120 to the indoor HX coil 106. The refrigerant carries an enthalpy $\Delta H_v$ due to compression, and an enthalpy due to condensation related to the phase change of the refrigerant from gas to liquid. The refrigerant is therefore typically warmer than the indoor ambient 108. A blower 132 controlled by the controller 130 moves air over the indoor HX coil 106, transferring heat from the refrigerant to the ID ambient 108, thus reducing the temperature of the refrigerant.

The refrigerant flows through a check valve 140 oriented to open in the illustrated direction of flow, causing the refrigerant to bypass a throttle 142. The refrigerant then flows through a filter/drier 144. A check valve 146 is oriented to close in the direction of flow, thus causing the refrigerant to flow through a throttle 148. A portion of the refrigerant vaporizes on the downstream, low pressure side of the throttle, thereby cooling according to $\Delta H_v$ and expansion. The cooling of the refrigerant causes the outdoor HX coil 102 to cool. A fan 150 controlled by the controller 130 moves air over the outdoor HX coil 102, transferring heat from the outdoor ambient 104 to the refrigerant. The refrigerant returns to the compressor 120 via flow valve 125, thus completing the refrigeration cycle.

The system 100 may also include an optional backup heat source 152, also controlled by the controller 130, for use in periodic frost removal from outdoor HX 102, inter alia. The backup heat source 152 may be conventional or novel, and may be powered by electricity, natural gas, or any other fuel.

Under some conditions, related to temperature, dew point of the outdoor ambient air, precipitation, and humidity levels, frost and/or ice may accumulate on the fan 150 and proximate components. A primary defrost cycle may be utilized for defrosting the outdoor HX coil 102. The controller 130 initiates the primary defrost cycle by signaling the indoor HX coil 106, in heat pump mode, the evaporating HX coil, to extract heat from the indoor space and the outdoor HX coil 102 thereafter releases heat which removes the frost from the HX coil 102, during which fan 150 is not running. The primary defrost cycle terminates when temperature sensor 154, proximate the outdoor HX coil 102 communicates to controller 130 that a first predetermined threshold temperature has been reach.

Under certain weather conditions, a secondary defrost may be necessary to remove frost from not only the outdoor HX coil 102, but also the fan 150 and proximate components and/or surfaces. The secondary defrost cycle will include the reverse-cycle defrost to remove frost from the outdoor HX coil, but after the first predetermined temperature is reached, the controller 130 turns on the fan at a substantially lower RPM rate compared to an operational RPM rate at which the fan may run during traditional heating or cooling mode. The secondary defrost cycle will continue until either a second predetermined temperature is reached at sensor 154, or after a set amount of time has passed.

Accordingly, some heat pump systems are configured to run a defrost cycle automatically in order to prevent or mitigate frost/ice buildup. Certain systems may be configured to automatically run the secondary defrost automatically. However, such running of the secondary defrost cycle at automatic intervals regardless of need is undesirable because of unnecessary and costly energy consumption and additional system reconfiguration associated with the running thereof. In addition, additional time may be lost for heating indoor ambient 108 during which the secondary defrost cycle is running. For example, work is performed transporting heat to the frosted coil and the fan 150. The dissipated heat associated with this work is lost to the ambient, and represents loss of efficiency of the conventional system. Electric (resistive) heat may be used to temper the indoor ambient during the defrost operation, but at the expense of additional energy consumption. Accordingly, one embodiment of the present disclosure utilizes weather data received for a geographic region proximate an installed location of the system 100 to select a defrost cycle.

Figure 2:
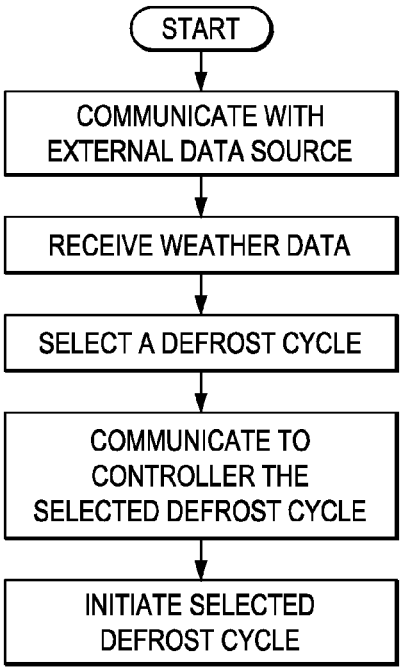
FIG. 2 is a flow diagram of a method of operating a heat pump system according to one embodiment of the disclosure.

Turning to FIG. 2, there is shown a method for operating a heat pump system 200, such as system 100 according to the present disclosure, the heat pump system configured to operate at least two defrost cycles, such as a primary and secondary defrost cycle. A controller may communicate with data sources external to the heat pump via traditional communication protocols including wired communications and various wireless network protocols. The controller may receive weather data for a geographic area proximate an installed location of system 100 from one or more of the external data sources, including, but not limited to ACCUWEATHER®, INTELLICAST®, THE WEATHER CHANNEL®, the National Oceanic and Atmospheric Administration (NOAA) National Weather Service, and various local weather services proximate the installation location of the heat pump system.

The controller reviews the received weather data and selects, based on the data, one of the at least two defrost cycles. Various weather conditions may prompt the need for a secondary defrost cycle. For example, if outdoor ambient is at or below a predetermined temperature, the controller may select a secondary defrost for defrosting the outdoor fan and proximate components. Further, certain humidity levels may prompt a secondary defrost cycle to be selected over a primary defrost cycle. Likewise, the controller may also be programmed to consider additional data inputs, such as historic data trends and service records according to the installation location of the heat pump system, in conjunction with the received weather data.

Figure 3:
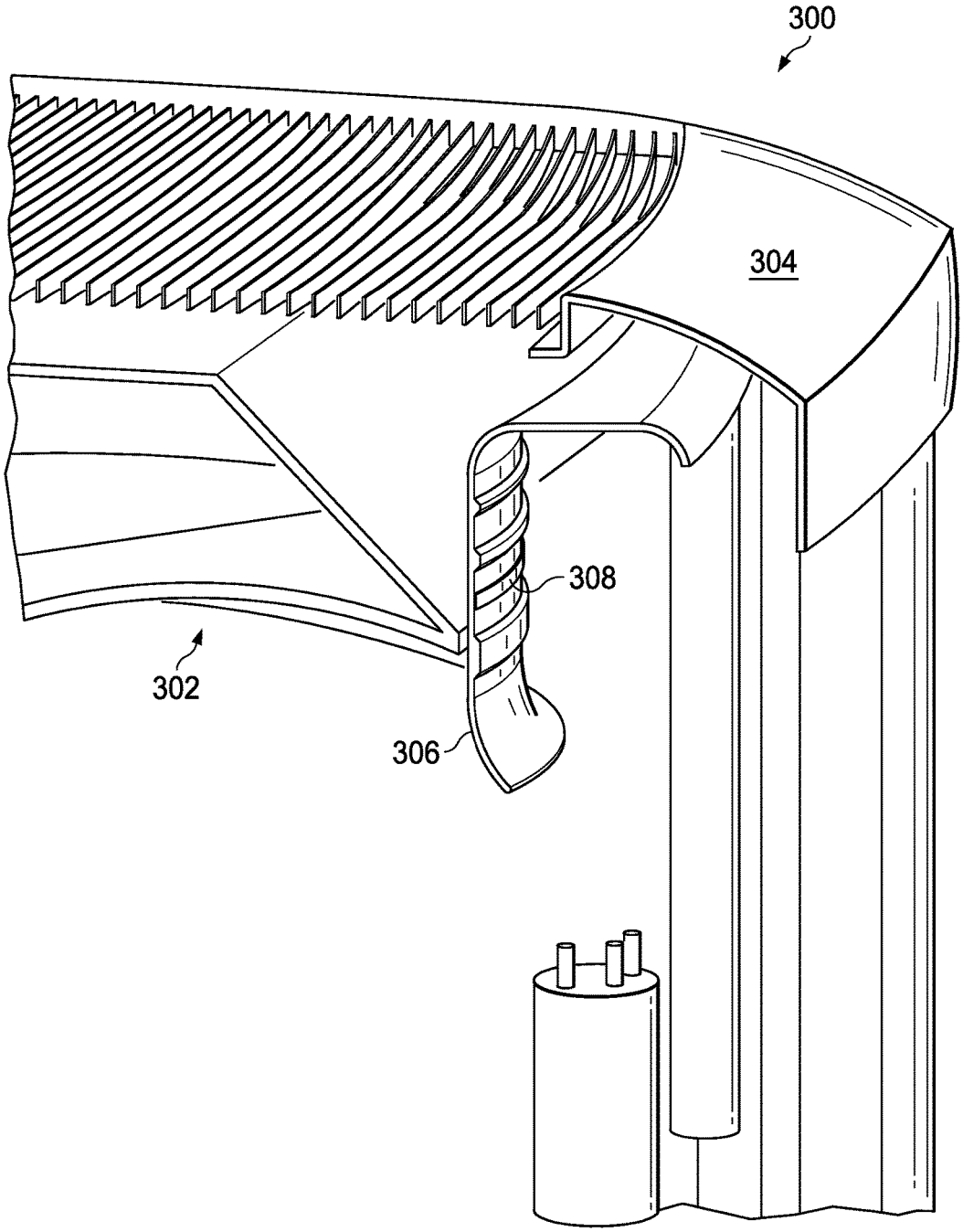
FIG. 3 is a perspective sectional view of one embodiment of an outdoor component comprising a heat pump system.

Referring now to FIG. 3, there is shown a cut-away of one embodiment of an outdoor unit 300 for a heat pump which may be used in certain embodiments of a heat pump system. A fan system comprises a fan 302 situated in a housing 304, generally placed outside and subject to various weather conditions. Concentric with and surrounding fan 302 is orifice ring 306. Coupled along orifice ring 306 is at least one heater 308. Heater 308 may comprise at least one electrically powered heating strip as shown, but heater 308 may comprise alternative shapes and forms in certain installations.

In some embodiments, when outdoor unit 300 experiences severe weather such as freezing precipitation (freezing rain, snow, sleet, hail, and the like) or near freezing temperatures, such as, e.g. 37°, with a relatively high humidity, ice may build up on the components within the unit 300 and in particular on the fan 302 and form an ice bridge between the fan 302 and orifice ring 306. During such conditions, a de-icing cycle may be used to remove the ice before operation of the outdoor unit becomes impaired. One embodiment of a de-icing cycle comprises running the heating strip 308, which heats the orifice ring 306 and at least portions of the fan 302 proximate to the orifice ring thereby melting and removing any ice accumulated thereon and any ice bridged between the orifice ring 308 and fan 302. Accordingly, utilizing the heating strip 308 for a de-icing cycle to remove ice may utilize less energy and enable the heat pump to maintain a higher heating and energy efficiency than if one of the primary or secondary defrost cycles is required. In some conditions, however, if the outdoor unit has accumulated frost, a defrost cycle may be needed in addition to or in place of a de-icing cycle.

Figure 4:
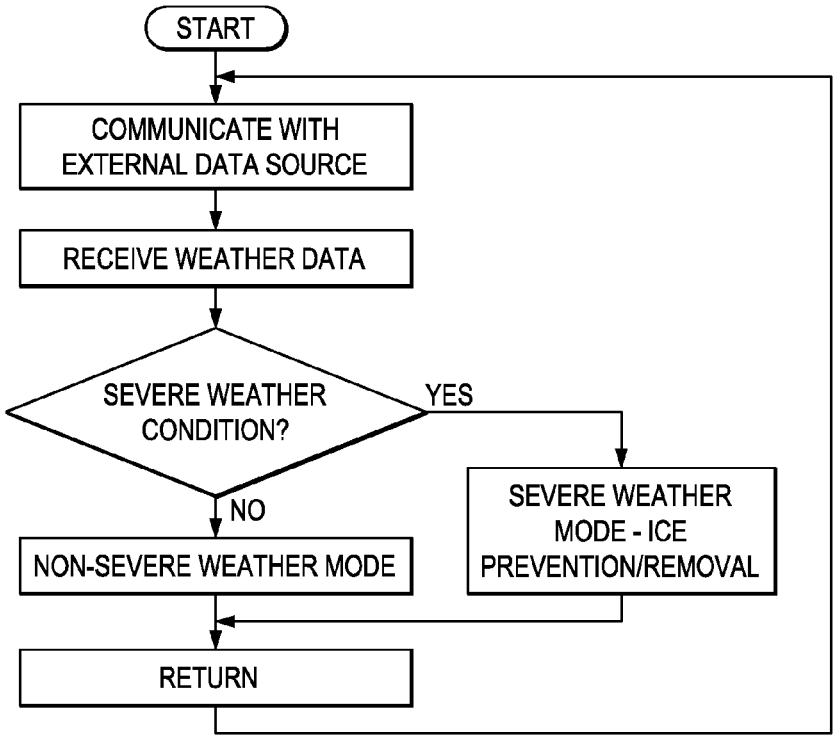
FIG. 4 is a flow diagram of a method of operating a heat pump system according to another embodiment of the disclosure.

Referring now to FIG. 4, there is shown another method of operating a heat pump system according to the present disclosure. A controller may communicate with data sources external to the heat pump via traditional communication protocols including wired communications and various wireless network protocols. The controller may receive weather data for a geographic area proximate an installed location of system 100 from one or more of the external data sources, including, but not limited to ACCUWEATHER®, INTELLICAST®, THE WEATHER CHANNEL®, the National Oceanic and Atmospheric Administration (NOAA) National Weather Service, and various local weather services proximate the installation location of the heat pump system.

The controller reviews the received weather data and determines whether severe weather conditions are present. Based on the weather data, the controller selects whether to operate in non-severe weather mode or severe weather mode. If severe weather conditions are present, the controller may select to operate in severe weather mode. Severe weather mode may comprise at least a de-icing cycle for ice prevention and or removal of ice buildup. One embodiment of the de-icing cycle comprises running a heating strip such as heating strip 308 to remove/prevent ice buildup on components within an outdoor unit comprising system 100.

If the controller determines that severe weather conditions are not present, the controller may select to operate in non-severe weather mode. Non-severe weather mode may comprise at least one defrost cycle for removing frost from system components. In some embodiments, the non-severe weather mode may comprise at least two defrost cycles such as the primary defrost and secondary defrost cycles discussed hereinabove from which the controller may select based on the received weather data. In some installations, the controller may also be programmed to consider additional data inputs, such as historic data trends and service records according to the installation location of the heat pump system, in conjunction with the received weather data. The controller may periodically re-communicate with one or more external data sources for updated weather data and accordingly select a different mode of operation if weather conditions have changed.

Those skilled in the art to which this application relates will appreciate that other and further additions, deletions, substitutions and modifications may be made to the described embodiments.

What is claimed is:

1. A controller for a heat pump system, the heat pump system configured to operate at least two defrost cycles, the controller configured to:

receive weather data for a defined geographic area proximate to an installed location of the heat pump system, the weather data comprising a humidity level;

determine whether the heat pump system is operating in a freezing precipitation condition based at least in part upon the humidity level;

determine whether to operate a de-icing cycle based at least in part upon the weather data, wherein the de-icing cycle comprises operating a heating strip on an orifice ring comprising an outdoor fan system of the heat pump system;

select, based at least in part upon determining whether the heat pump system is operating in the freezing precipitation condition, one of the at least two defrost cycles; and operate the de-icing cycle prior to operating the one of the at least two defrost cycles, based at least in part upon determining whether to operate the de-icing cycle based at least in part upon the weather data.

2. The controller according to claim 1, further configured to communicate with data sources external to the heat pump system.

3. The controller according to claim 1, further configured to communicate with components of the heat pump system via a data bus.

4. The controller according to claim 1, further configured to communicate with sources external to the heat pump system via a wireless network protocol.

5. The controller according to claim 1, wherein the defrost cycle selected is a primary defrost cycle, said primary defrost cycle comprising initiating a cooling cycle wherein an evaporating heat exchanger operates as a condenser thereby increasing a temperature proximate the heat exchanger, the primary defrost cycle terminating upon achieving a first predetermined threshold temperature of the heat exchanger.

6. The controller according to claim 1, wherein the selected defrost cycle comprises a secondary defrost cycle, said secondary defrost cycle comprising initiating a cooling cycle wherein an evaporating heat exchanger operates as a condenser thereby increasing a temperature proximate the heat exchanger, the secondary defrost terminating upon achieving a second threshold temperature of the heat exchanger.

7. The controller according to claim 1, wherein the selected defrost cycle comprises a secondary defrost cycle, said secondary defrost cycle comprising initiating a cooling cycle wherein an evaporating heat exchanger operates as a condenser thereby increasing a temperature proximate the heat exchanger, the secondary defrost terminating after a predetermined period of time has passed.

8. A method of operating a heat pump system, the heat pump system having at least a controller and configured to operate at least two defrost cycles, the method comprising:

receiving, at said controller, weather data for a defined geographic area proximate to an installed location of the heat pump system, the weather data comprising a humidity level;

determining, at said controller, whether the heat pump system is operating in a freezing precipitation condition based at least in part upon the humidity level;

determining, at said controller, whether to operate a de-icing cycle based at least in part upon the weather data, wherein the de-icing cycle comprises operating a heating strip on an orifice ring comprising an outdoor fan system of the heat pump system;

selecting, based at least in part upon determining whether the heat pump system is operating in the freezing precipitation condition data, one of the at least two defrost cycles; and operating the de-icing cycle prior to operating the one of the at least two defrost cycles, based at least in part upon determining whether to operate the de-icing cycle based at least in part upon the weather data.

9. The method according to claim 8, wherein said method is performed during manufacturing or testing of said heat pump system.

10. The method according to claim 8, wherein said controller is further configured to communicate with data sources external to the heat pump system.

11. The method according to claim 8, wherein the defrost cycle selected is a primary defrost cycle, said primary defrost cycle comprising initiating a cooling cycle wherein an evaporating heat exchanger operates as a condenser thereby increasing a temperature proximate the heat exchanger, the primary defrost cycle terminating upon achieving a first predetermined threshold temperature of the heat exchanger.

12. The method according to claim 8, wherein the selected defrost cycle comprises a secondary defrost cycle, said secondary defrost cycle comprising initiating a cooling cycle wherein an evaporating heat exchanger operates as a condenser thereby increasing a temperature proximate the heat exchanger, the secondary defrost terminating upon achieving a second threshold temperature of the heat exchanger.

13. The method according to claim 8, wherein the selected defrost cycle comprises a secondary defrost cycle, said secondary defrost cycle comprising initiating a cooling cycle wherein an evaporating heat exchanger operates as a condenser thereby increasing a temperature proximate the heat exchanger, the secondary defrost terminating after a predetermined period of time has passed.

* * * * *